US005234216A

United States Patent [19]

Ostendorff

[11] Patent Number: 5,234,216

[45] Date of Patent: Aug. 10, 1993

[54] TOY VEHICLE CRASH SIMULATING PLAYSET

[75] Inventor: Eric C. Ostendorff, Torrance, Calif.

[73] Assignee: Mattel, Inc., El Segundo, Calif.

[21] Appl. No.: 930,644

[22] Filed: Aug. 17, 1992

[51] Int. Cl.[5] ..... A63B 71/04

[52] U.S. Cl. ..... 273/127 A; 273/17 R; 273/17 D; 446/4

[58] Field of Search ..... 273/108, 127 R, 127 A, 273/127 B, 127 D, 348, 379, 380, 386, 390, 393, 397, 86 D; 446/4, 6

[56] References Cited

U.S. PATENT DOCUMENTS

| | | | |
|---|---|---|---|
| 276,539 | 4/1883 | Reed . | |
| 646,115 | 3/1900 | Wichmann . | |
| 1,235,771 | 8/1917 | Dettra . | |
| 2,308,524 | 1/1943 | Longnecker | 446/4 |
| 2,385,724 | 9/1945 | Olsoa . | |
| 2,457,653 | 12/1948 | Froelich . | |
| 2,597,094 | 5/1985 | Gutmann . | |
| 3,000,137 | 9/1961 | Vine . | |
| 3,176,429 | 4/1965 | Brown et al. . | |
| 3,713,654 | 1/1973 | Goldfarb | 273/127 A X |
| 4,513,967 | 4/1985 | Halford et al. | 273/108 |
| 4,519,789 | 5/1985 | Halford et al. . | |
| 4,558,867 | 12/1985 | Hippely . | |

FOREIGN PATENT DOCUMENTS

| | | |
|---|---|---|
| 2038611 | 2/1972 | Fed. Rep. of Germany . |
| 8133 | 3/1916 | United Kingdom . |
| 413423 | 7/1934 | United Kingdom . |
| 2133711 | 8/1984 | United Kingdom . |

*Primary Examiner*—V. Millin
*Assistant Examiner*—Raleigh W. Chiu
*Attorney, Agent, or Firm*—Roy A. Ekstrand

[57] ABSTRACT

A toy vehicle crash simulating playset includes a crash simulator having a support base to which a pair of toy vehicles are pivotally secured in a spaced apart arrangement. Each toy vehicle is pivotally secured at the outer portion thereof and a spring mechanism urges the toy vehicles toward pivotal motion away from the base. A releasable latch mechanism is operative upon each toy vehicle which releases upon impact permitting abrupt high energy pivotal motion thereof. A third toy vehicle is receivable between the two spring-loaded toy vehicles and interacts therewith when impacted to also cause the release of the latching mechanisms.

12 Claims, 3 Drawing Sheets

TOY VEHICLE CRASH SIMULATING PLAYSET

FIELD OF THE INVENTION

This invention relates generally to toy vehicle playsets and particularly to those simulating crash sites or collisions.

BACKGROUND OF THE INVENTION

Toy vehicle playsets have enjoyed great popularity through the years and have provided a variety of toy vehicles both powered and unpowered together with cooperating accessories. In some toy vehicle playsets, an unpowered vehicle is launched or started into a confining track set which may be multiply curved and convoluted to wind the toy vehicle through a variety of turns, loops, and other stunts. In still others, collision or crash simulation is provided in which toy vehicles are impact responsive to provide separation and apparent explosion of multiply articulated car bodies having spring-loaded exploding mechanisms therein. All of the foregoing combine to provide a variety of playsets offering the child user substantial amusement, entertainment, and enjoyment.

For example, U.S. Pat. No. 4,558,867 issued to Hippely sets forth a TOY VEHICLE TRACKWAY SET including a base member defining a circular ramp, a vehicle loop, a straight track segment and a vehicle receiving net. The trackway set is assembled in a first configuration in which a self-powered toy vehicle may be accelerated sequentially through the straight track, the loop and the ramp and be launched from the ramp toward a receiving net. The entire assembly snap fits into a compact storage configuration.

U.S. Pat. No. 4,519,789 issued to Halford et al sets forth a COMBINED JUMP MEANS AND TOY VEHICLE WITH SIMULATED STUNT 15 HOOP having a toy vehicle, a jump for the vehicle, a tower holding a swinging hoop and a flame design encircling the hoop. The toy vehicle accelerates through the jump and is launched through the center aperture of the flame simulating hoop.

German Patent No. 2,038,611 sets forth a flying jump for model cars which can be adjusted in length by remote control using a Bowden cable to alter the sliding action below the jump. Markers on the track are knocked over by contact with the vehicle.

U.S. Pat. No. 2,597,094 issued to Gutmann sets forth an IMPACT OPERATED TOY having a toy vehicle replicating a car or the like defining a hinged chassis and multiply articulated and hinged body configurable in either a closed "normal" position or an exploded or "wrecked" configuration. Spring biasing means are provided together with latch means to produce an abrupt transition from normal to wrecked configuration.

U.S. Pat. No. 3,000,137 issued to Vine sets forth a SELF-UPSETTING TOY VEHICLE having a impact responsive bumper trigger coupled to a spring-loaded latched upsetting lever beneath the car. When impact is sensed by the bumper trigger, the latch is released and a captive spring forces the upsetting lever downwardly against the play surface flipping the toy vehicle.

U.S. Pat. No. 3,176,429 issued to Brown et al sets forth a TOY VEHICLE EXPLODABLE ON CONTACT WITH AN OBJECT having an impact sensitive bumper coupled to a trigger release latch mechanism. The toy vehicle includes a plurality of multiply articulated body and chassis components which are locked in place in opposition to a captive spring and are released by bumper impact.

British Patent No. 413,423 sets forth IMPROVEMENTS IN OR RELATING TO TOYS in which a plurality of exploding vehicles such as a war ship or the like includes spring-loaded exploding means and trigger control means.

U.S. Pat. No. 2,385,724 issued to Olson sets forth a TOY having a war ship comprising a hull and a plurality of articulated super structure and deck components. A spring-loaded exploder is supported within the hull interior and is latched in place by a trigger mechanism. A trigger rod extends upwardly from the trigger mechanism and is operative when struck by falling objects such as a simulated bomb to release the exploder and simulate ship explosion upon bomb impact.

U.S. Pat. No. 646,115 issued to Wichmann sets forth a TOY having a war ship supporting a plurality of deck and super structure components together with a spring-loaded exploding mechanism which is released on impact to simulate ship explosion.

British Patent No. 2,133,711 issued to Semark sets forth an EXPLODING TOY E.G. A TARGET SHIP includes an assembly of separate pieces arranged together with resilient means such as a compressible spring. The assembly may be deformed and released to cause the assembly to explode into separate pieces.

U.S. Pat. No. 276,539 issued to Reed sets forth a KNOCK DOWN OR BUILDING BLOCK TOY having a box-like housing within which a spring-loaded exploding mechanism and trigger are supported. A plurality of additional building components are supported upon the building frame and a target mechanism releases a captive spring on impact to simulate explosion.

U.S. Pat. No. 1,235,771 issued to Dettra sets forth a TOY having a simulated war ship supporting a plurality of separate super structure and deck components together with a spring-loaded releasable exploding mechanism.

U.S. Pat. No. 2,457,653 issued to Froelich sets forth a KNOCK APART TOY having a simulated military vehicle or the like which includes a plurality of separable components and a spring-loaded release mechanism which produces simulated explosion upon impact.

British Patent No. 8133 issued to Headworth sets forth a MECHANICAL TOY BRIDGE having a pair of bridge abutments supporting a pair of articulated span members which are separable and movable between upwardly separated extending positions and inwardly extending closed positions.

While the foregoing described prior art devices have provided enjoyment and amusement to a variety of children, these mechanisms are often complex and expensive to manufacture. In addition, many have utilized a plurality of parts which are easily lost by younger children reducing the play value of the playsets. Therefore there remains a continuing need in the art for inexpensive, easy to use and dramatic toy vehicle playsets which younger children can manipulate and which tend to avoid the loss or separation of major system components.

SUMMARY OF THE INVENTION

Accordingly, it is a general object of the present invention to provide an improved toy vehicle playset. It is a more particular object of the present invention to provide an improved toy vehicle playset simulating crash activities which avoids the loss of major system components and which is relatively inexpensive to manufacture.

In accordance with the present invention, there is provided a toy vehicle crash simulating playset which comprises a support base, a pair of pivoting toy vehicles pivotally supported upon the base in a spaced apart arrangement, spring means urging the pivoting toy vehicles in a pivotal direction away from the base, and latch means restraining the pivoting toy vehicles in the spaced apart arrangement upon the base, the latch means releasing a pivoting toy vehicle upon impact thereto permitting the spring means to pivot it upwardly from the base.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figures 1, 4:
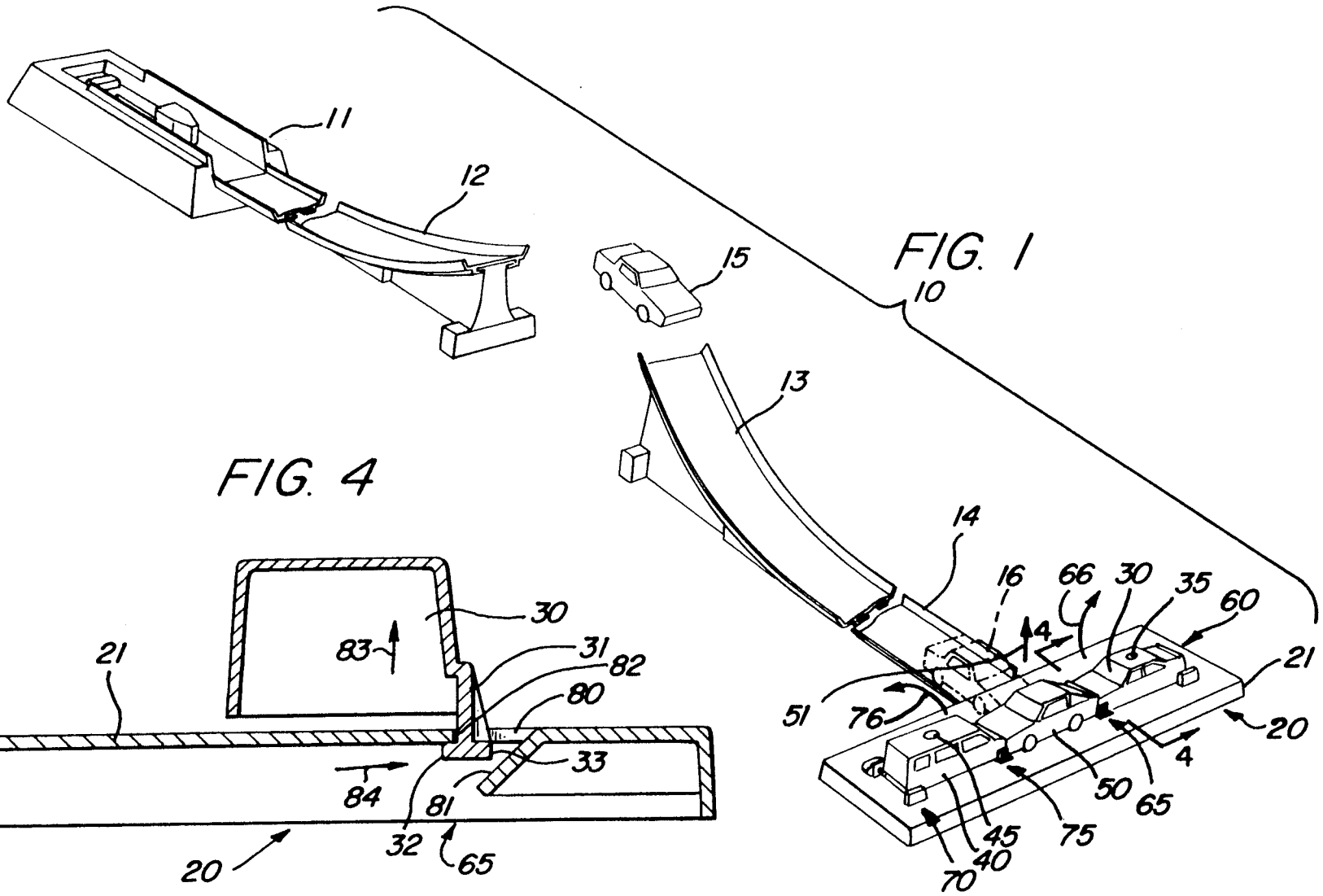
FIG. 1 sets forth a perspective view of a toy vehicle crash simulating playset constructed in accordance with the present invention.
FIG. 4 sets forth a section view of the crash simulating portion of the present invention playset taken along section lines 4—4 in FIG. 1.

FIG. 1 sets forth a perspective view of a toy vehicle crash simulating playset constructed in accordance with the present invention and generally referenced by numeral 10. Playset 10 includes a toy vehicle launcher 11 coupled to an upwardly inclined jump ramp 12. A downwardly inclined landing ramp 13 and track segment 14 are directed toward a crash simulator 20. Crash simulator 20 includes a generally planar base 21. Crash simulator 20 further includes a pair of simulated toy vehicles 30 and 40 each pivotally secured at the outer portions thereof to base 21 by a pair of spring biased pivots 60 and 70, respectively. A pair of latch mechanisms 65 and 75 releasably secure toy vehicles 30 and 40 in the position shown upon base 21. A center vehicle 50 is positioned between spring-loaded vehicles 30 and 40 upon base 21. For reasons set forth below, toy vehicles 30 and 40 define inwardly extending indent recesses 35 and 45, respectively, on the upper surfaces thereof. The operation of indent recesses 35 and 45 is set forth below in greater below. However, suffice it to note here that recesses 35 and 45 facilitate the nested stacking of additional toy vehicles such as center vehicle 50 upon the upper portions of vehicles 30 and 40 to enhance the crash action of crash simulator 20.

In operation, a toy vehicle such as launched vehicle 15 is loaded into launcher 11 and, in accordance with conventional fabrication techniques, is launched therefrom with sufficient energy to be propelled upwardly from jump ramp 11 and across the intervening space to land upon landing ramp 13. Upon landing on ramp 13, the toy vehicle continues through track segment 14 to arrive at base 21 in the position shown for impacting vehicle 16. The impact of impacting vehicle 16 applied to center vehicle 50 is operative by means set forth below in greater detail to release latch mechanisms 65 and 75. Upon release of latch mechanisms 65 and 75, spring-loaded vehicles 30 and 40 pivot upwardly about pivots 60 and 70, respectively, in the directions indicated by arrows 66 and 76 while maintaining their pivotal attachments to base 21. As is better seen in FIG. 3, toy vehicles 30 and 40 also include extending members which extend beneath center vehicle 50 whereby the pivotal motion of vehicles 30 and 40 imparts an upward force upon center vehicle 50 in the direction indicated by arrow 51 away from base 21.

Thus, in accordance with the preferred operation of the present invention crash simulating playset, the impact of a toy vehicle against center vehicle 50 simultaneously releases spring-loaded pivoting mechanisms operable upon vehicles 30 and 40 to abruptly pivot vehicles 30 and 40 and thrust vehicle 50 into the air to provide an exciting crash simulation.

Crash simulator 20 is restored to the spring-loaded configuration shown in FIG. 1 by simply forcing vehicles 30 and 40 downwardly in pivotal directions opposite to arrows 66 and 76, respectively, overcoming their respective spring pivot forces and latching vehicles 30 and 40 to base 21. Center vehicle 50 is thereafter simply placed in the center position shown in FIG. 1. To further enhance the excitement of crash simulation and exploding action, additional toy vehicles may be stacked upon vehicles 30, 40 and 50 in the manner shown in FIG. 5 to increase the number of toy vehicles being hurled about as crash simulator 20 is triggered by vehicle impact. As will be set forth below in greater detail, the impact of a vehicle such as impacting vehicle 16 against center vehicle 50 produces simultaneous release of both vehicles 30 and 40. Alternatively, to add more variation and interest to crash simulation, track 14 may be realigned to target either vehicle 30 or 40 rather than center vehicle 50. In such event, the impact of a launched vehicle against toy vehicle 30, for example, does not disturb the latch mechanism of vehicle 40, but releases vehicle 30 and launches center vehicle 50 in an erratic spinning launch different from that provided by direct impact upon vehicle 50. Conversely, impact directed solely against vehicle 40 leaves vehicle 30 undisturbed and launches center vehicle 50 in an erratic opposite direction spinning launch while releasing the pivotal motion of vehicle 40. Thus, it will be apparent to those skilled in the art that the crash simulation of crash simulator 20 may be varied considerably by selection of impact area and by creative stacking of additional toy vehicles or other objects upon vehicles 30, 40 and 50. It will be equally apparent to those skilled in the art that the operation of launcher 11, jump ramp 12, landing ramp 13 and track 14 may be constructed in accordance with conventional fabrication techniques in which virtually any launch mechanism including simple hand rolling and release of a rolling toy vehicle or self-powered vehicle may be used to present an impacting vehicle against crash simulator 20. Thus, crash simulator 20 is usable with a very simple playset in which the user simply grasps an impacting car and hurls it or rolls it toward crash simulator 20 or a complex playset in which a multiply curved and/or looped track and complicated launcher or powered toy vehicle is used.

Figures 2, 3:
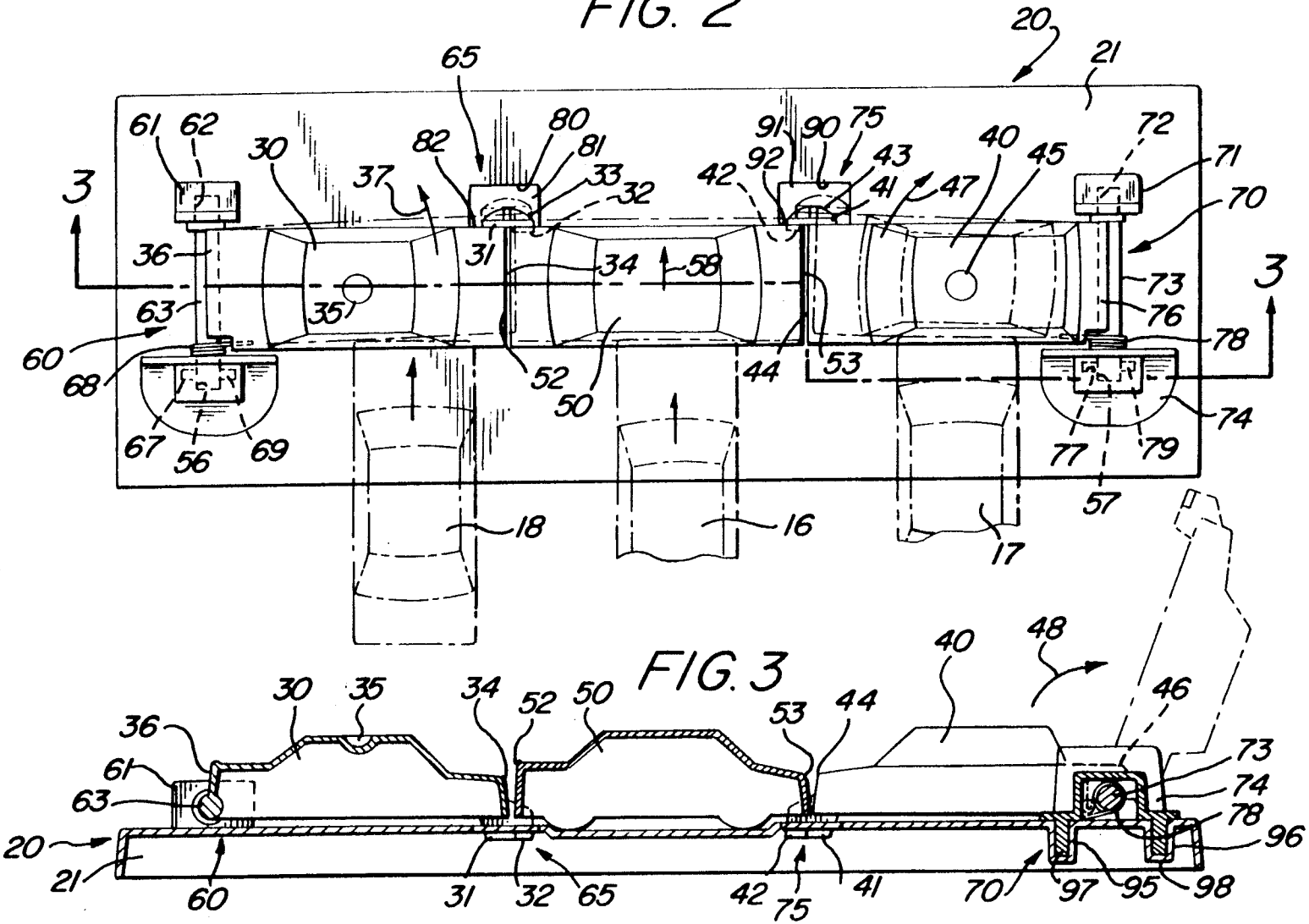
FIG. 2 sets forth a top plan view of the crash simulating portion of the present invention playset.
FIG. 3 sets forth a section view of the crash simulating portion of FIG. 2 taken along section lines 3—3 therein.

FIG. 2 sets forth a top view of crash simulator 20 in the latched or spring-loaded position depicting impacts of toy vehicles in various combinations against vehicles 30, 40 and 50. As described above, crash simulator 20 includes a generally planar base 21 having a pair of pivotally secured toy vehicles 30 and 40 and receiving a center vehicle 50. As is also described above, vehicle 30 is secured to base 21 by a pivotal attachment 60 while vehicle 40 is secured to base 21 by a pivotal attachment 70. Vehicle 50 is unattached to base 21 and rests upon the upper surface thereof between vehicles 30 and 40.

Pivot 60 includes an upwardly extending pivot bearing 61 secured to base 21 and defining a bearing passage 62. Pivot 60 further includes a pivot housing 64 secured to base 21 and defining a recess 56 and an outwardly extending groove 67. Pivot 60 further includes an elongated cylindrical rod 63 having one end thereof received within passage 62 of bearing 61 and the remaining end received within recess 56 of pivot housing 64. A thrust flange 69 is secured to pivot rod 63 and is received within groove 67. Vehicle 30 defines a front portion 34 and a rear portion 36. The latter is secured to pivot rod 63 between bearing 61 and pivot housing 64. A spring 68 is received upon pivot rod 63 and is coupled between base 21 and rear portion 36 of vehicle 30 providing a spring force acting to pivot vehicle 30 about pivot rod 63 in the direction raising front 34 upwardly from base 21 as shown in FIG. 1.

A latch mechanism 65 includes an aperture 80 formed in the upper surface of base 21 and having a downwardly sloped surface 81 formed therein. Aperture 80 further defines an edge 82. Correspondingly, vehicle 30 defines a planar latch plate 31 (better seen in FIG. 4). Latch plate 31 further includes an inwardly extending latch tab 32 and an outwardly extending curved latch cam 33.

In the latched position shown in FIG. 2, toy vehicle 30 is aligned with respect to edge 82 of aperture 80 such that latch plate 31 generally abuts edge 82 and as a result, latch tab 32 extends beneath edge 82 in the manner better seen in FIG. 4. The extension of latch tab 32 beneath edge 82 provides a reliable latch which resists the spring force of spring 68 urging vehicle 30 to pivot upwardly from base 21. In accordance with an important aspect of the present invention, pivot rod 63 is loosely fitted within passage 62 of pivot bearing 61 and recess 56 of pivot housing 64. As a result, vehicle 30 may be angularly moved upon base 21 in the direction indicated by arrow 37. Thus, in the event an impact force such as that produced by left impacting vehicle 18 is applied to vehicle 30 in the manner shown, vehicle 30 pivots angularly upon base 21 in the direction indicated by arrow 37 to the dashed line position shown in FIG. 2. As vehicle 30 moves angularly upon base 21, latch tab 32 is removed from edge 82 while cam 33 rides upwardly upon sloped surface 84. As a result, the latching mechanism provided by latch tab 32 and edge 82 is released. Once the latch mechanism of latch 65 is released, spring 68 abruptly pivots vehicle 30 upwardly about pivot rod 63 in the manner shown in FIG. 1 providing the above-described crash simulation.

Vehicle 40, pivot 70 and latch mechanism 75 are substantially identical to vehicle 30, pivot 60 and latch mechanism 65, respectively. Thus, pivot 70 includes an upwardly extending pivot bearing 71 defining an interior passage 72. Pivot 70 further includes an upwardly extending pivot housing 74 defining a recess 57 and an annular groove 77 therein. An elongated, cylindrical pivot rod 73 is received at one end within passage 72 of pivot bearing 71 while the other end is received within recess 57. Pivot rod 73 further defines a thrust flange 79 which is received within groove 77 of recess 57. Toy vehicle 40 is secured to pivot rod 73 at rear portion 46. A spring 78 is received upon pivot rod 73 and exerts a spring force between base 21 and vehicle 40 urging vehicle 40 to pivot upwardly from base 21 raising front 44 of vehicle 40.

Latch 75 includes a latch plate 41 supported at front 44 of vehicle 40 having a latch tab 42 extending inwardly therefrom and a latch cam surface 43 extending outwardly therefrom. Latch 75 further includes a rectangular aperture 90 defined in the upper surface of base 21 having a downwardly sloped surface 91 and an edge 92.

In the latched position shown in FIG. 2, vehicle 40 is pivoted downwardly upon base 21 such that latch plate 41 extends downwardly into aperture 90 and latch tab 42 extends beneath edge 92 of aperture 90. When so positioned, the latching action of tab 42 beneath edge 92 resists the force of spring 78 and maintains the latched position of vehicle 40. As described above for vehicle 30, vehicle 40 is also loosely fitted within pivot bearing 71 and pivot housing 74 due to a slightly reduced size of pivot rod 73. Thus, vehicle 40 is angularly pivotable upon base 21 in the lateral direction shown by arrow 47 to the dashed line depiction of FIG. 2.

In operation, an impacting vehicle such as right impacting vehicle 17 striking vehicle 40 in the manner shown in FIG. 2 produces the above-described lateral pivoting motion in the direction of arrow 47. As vehicle 40 moves laterally, latch tab 42 is withdrawn from its position underlying edge 92 and cam 43 rides upwardly upon sloped surface 91. As a result, the attachment of latch 75 is released and the spring force of spring 78 is no longer resisted As a result, spring 78 pivots vehicle 40 about rear 46 upwardly from base 21 in the manner shown in FIG. 1.

Thus, it will be apparent to those skilled in the art that either vehicle 30 or 40 may be released and caused to rapidly pivot upwardly upon receiving an impact to release latches 65 and 75. Vehicle 50 is positioned between vehicles 30 and 40 and merely rests upon base 21. Thus, vehicle 50 is otherwise free of base 21 and is not in any way latched thereto. In accordance with the preferred play pattern of crash simulator 20, the degree of impact upon either vehicle 30 or 40 and the placement of such impact provides some flexibility in the response of crash simulator 20. For example, in the event vehicle 30 or 40 are struck severely and rapidly, they will pivot rearwardly and release latches 65 or 75 abruptly. If the impacting force is sufficient, latch tab 32 may clear vehicle 50 as the impacted vehicle rises in the above pivotal motion. On the other hand, if the impact against vehicle 30 or 40 is less abrupt and especially if it also overlaps onto a portion of vehicle 50, the upwardly rise of the pivoting vehicle may cause its latch tab to also interact with vehicle 50 sending it spinning upwardly as described above. The size and position of vehicle 50 also influences whether vehicle 50 is interacted with in the event vehicles 30 or 40 are singularly impacted. As a result, the present invention playset offers a great variety of play patterns in that, with skillful operation, the user may be able to direct an impacting vehicle so as to produce response by a single one of vehicles 30, 40 or 50 or by center impact, release both vehicles 30 and 40 and provide a maximum result. This maximum result is depicted as center impact 16 in FIG. 2. As can be seen, a center impact upon vehicle 50 drives or forces vehicle 50 rearwardly in the direction indicated by arrow 58. As vehicle 50 moves rearwardly in the direction of arrow 58, front portion 34 impacts latch plate 31 of vehicle 30 forcing it rearwardly and releasing latch 65. Concurrently, the rearward motion of vehicle 50 under impact forces front 53 thereof against latch plate 41 of vehicle 40 releasing latch 75 and causing vehicle 40 to pivot upwardly. The result is, as described above, a maximal response of crash simulator 20.

FIG. 3 sets forth a section view of crash simulator 20 taken along section liens 3—3 in FIG. 2. As described above, crash simulator 20 includes a generally planar base 21 having vehicles 30, 40 and 50 supported thereon. A pivot 60 includes a pivot bearing 61 having a pivot rod 63 secured thereto. Vehicle 30 includes an indent 35 in the upper surface thereof and a rear portion 36 secured to pivot rod 63. Vehicle 30 further includes a downwardly extending latch plate 31 having a latch tab 32. Latch plate 31 and latch tab 32 cooperate to interact with aperture 80 (seen in FIG. 2) to provide latch mechanism 65.

Base 21 further includes a pivot housing 74 supporting a pivot rod 73 and a spring 78. Toy vehicle 40 includes a rear portion 46 secured to pivot rod 73 in the manner described above. Vehicle 40 further includes a downwardly extending latch plate 41 having an inwardly extending latch tab 42. Latch plate 41 and latch tab 42 cooperate with aperture 90 (seen in FIG. 2) to form latch mechanism 75. A toy vehicle 50 defines a front portion 53 and a rear portion 52 and is received and rests upon base 21 between vehicles 30 and 40.

Base 21 further defines a plurality of downwardly extending recesses such as recesses 95 and 96. Correspondingly, pivot housing 74 defines a plurality of downwardly extending boss members 97 and 98 which are received within recesses 95 and 96, respectively, to secure pivot housing 74 to base 21. Conventional attachment means such as adhesives or sonic welding or the like may be utilized to further secure pivot housing 74. Spring 78 is captivated between base 21 and vehicle 40 and thus, upon the release of latch 75, pivots vehicle 40 in the manner indicated by arrow 48. While not seen in FIG. 3, it should be understood that pivot housing 64 of pivot 60 is similarly secured to base 21 of crash simulator 20.

FIG. 4 sets forth a section view of vehicle 30 and latch 65 together with base 21 taken along section lines 4—4 in FIG. 1. Thus, crash simulator 20 includes a base 21 defining an aperture 80 having a downwardly sloped surface 81 and an edge 82. Vehicle 30 defines a downwardly extending latch plate 31 which, in turn, defines an inwardly extending latch tab 32 and an outwardly extending latch cam 33. Latch tab 32 extends beneath edge 82 of aperture 80. As is set forth above in FIG. 2, spring 68 exerts a pivoting spring force against vehicle 30 urging the front portion thereof to move upwardly from base 21 in the direction indicated by arrow 83 in FIG. 4. Latch tab 32 extends beneath edge 82 and thus resists this upward motion providing the above-described latching action for latch mechanism 65. Vehicle 30 is released by impact against vehicle 30 in the direction indicated by arrow 84 which, due to the above-described loose pivotal attachment of vehicle 30, permits vehicle 30 to move laterally in the direction indicated by arrow 84 a sufficient distance to slide latch tab 32 outwardly from beneath edge 82. Concurrently, cam surface 33 impacts sloped surface 81 as vehicle 30 moves laterally. Once latch tab 32 clears edge 82, the spring force of spring 68 (seen in FIG. 1) is no longer opposed and vehicle 30 pivots upwardly in the manner described above.

It should be understood that the latch mechanism operative to form latch 75 for vehicle 40 is identical to latch mechanism 65 for vehicle 30. Thus, FIG. 4 should be understood to apply equally well in disclosing the structure of latch 75.

Figure 5:
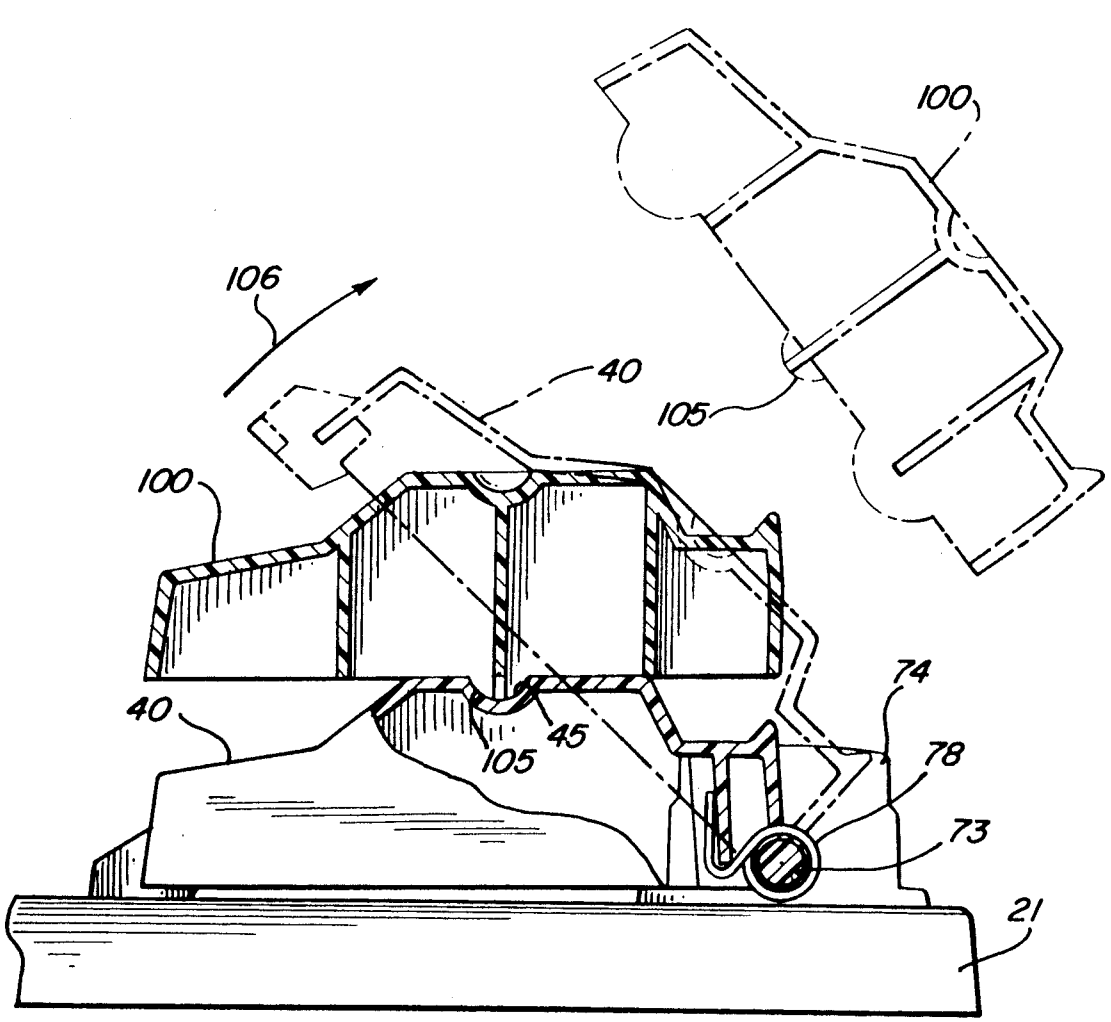
FIG. 5 sets forth a partially sectioned view of the secondary car launching function of the present invention toy vehicle crash simulating playset.

FIG. 5 sets forth a partial section view of toy vehicle 40 having a nested toy vehicle 100 disposed on the upper portion thereof. As described above, toy vehicle 40 is supported upon base 21 by a pivot housing 74 and a pivot rod 73. As is also described above, a spring 78 urges vehicle 40 to pivot away from base 21 in the direction indicated by arrow 106. Toy vehicle 40 defines an indent 45 on the upper surface thereof. An auxiliary toy vehicle 100 includes a downwardly extending projection 105 which is nestable within indent 45 of vehicle 40. As a result, vehicle 100 is conveniently stackable upon toy vehicle 40. During the above-described pivotal motion of vehicle 40 responding to impact thereto, vehicle 40 pivots upwardly in the direction of arrow 106 causing toy vehicle 100 to be rapidly thrust upwardly in the manner shown in dashed line representation in an erratic and explosive spinning motion which provides great excitement for the present invention toy vehicle playset. It should be noted that toy vehicle 100 defines a further indent in its upper portion 107 which facilitates the stacking of an additional car upon its upper portion. As a result, it should be apparent to those skilled in the art that a number of toy vehicles may be stacked in accordance with the present invention and thus produce a virtually endless array of toy vehicle configurations which respond to impact in an exciting manner. It should also be apparent to those skilled in the art that a similar group of toy vehicles such as vehicle 100 may also be stacked upon toy vehicle 40 using indent 35 thereof (seen in FIG. 2)

What has been shown is an exciting toy vehicle crash simulating playset which provides great flexibility in use by the child user. The playset shown utilizes rapidly pivoting vehicles supported by a playset base to provide exciting crash simulation while utilizing a minimum of removable parts which can become broken or lost by the child user. A variety of impact scenarios may be initiated by the child user simply by selecting where the array of spring-loaded toy vehicles on the crash simulator is impacted. The permanent pivotal attachment of the spring-loaded toy vehicles to the crash simulator base further precludes the loss or damage to the toy vehicle crash set.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

That which is claimed is:

1. A toy vehicle crash simulating playset comprising:
a support base;
a pair of pivoting toy vehicles pivotally supported upon said base in a spaced apart arrangement;
spring means urging said pivoting toy vehicles in a pivotal direction away from said base; and
latch means restraining said pivoting toy vehicles in said spaced apart arrangement upon said base, said latch means releasing a pivoting toy vehicle upon impact thereto permitting said spring means to pivot it upwardly from said base.

2. A playset as set forth in claim 1 wherein said base defines a pair of apertures and wherein said latch means includes a pair of latch plates supported on said pivoting toy vehicles and extending into said apertures, said latch plates each defining a latch tab for engaging said base within said apertures.

3. A playset as set forth in claim 2 wherein said latch plates each include an inwardly extending portion and wherein said playset further includes a third vehicle placeable upon said base and extending between said pivoting toy vehicles to extend across a portion of each of said inwardly extending portions of said latch plates.

4. A playset as set forth in claim 3 wherein said pivoting toy vehicles each define first nesting means and wherein said playset further includes at least one toy vehicle having second nesting means cooperating with said first nesting means to stack upon a selected one of said pivoting toy vehicles.

5. A playset as set forth in claim 4 wherein said pivoting toy vehicles are commonly aligned and inwardly facing.

6. A playset as set forth in claim 5 wherein said pivoting toy vehicles pivot in opposite directions when said latch means are released.

7. A toy vehicle playset for use with a freely rolling impact vehicle, said playset comprising:
a base;
at least one pivoting toy vehicle pivotally secured at one end thereof to said base and pivotable between a first position appearing to rest upon said base and a second position extending upwardly on-end therefrom;
spring means coupled between said pivoting toy vehicle and said base urging said pivoting toy vehicle toward said second position; and
latch means coupled between said pivoting toy vehicle and said base releasably latching said pivoting toy vehicle in said first position and releasing said pivoting toy vehicle when impacted by said impact vehicle.

8. A toy vehicle as set forth in claim 7 wherein said pivoting toy vehicle is laterally pivotable upon said base and wherein said latch means release in response to said lateral motion.

9. A toy vehicle playset comprising:
a base;
a pair of pivoting toy vehicles having spring means urging said pivoting toy vehicles to pivot upwardly from said base; and
impact responsive latch means latching said pivoting toy vehicles in an aligned arrangement in opposition to said spring means.

10. A playset as set forth in claim 9 including a plurality of stackable toy vehicles receivable upon said pivoting toy vehicles.

11. A playset as set forth in claim 10 wherein said pivoting toy vehicles are aligned upon said base and spaced apart to define a space therebetween and outer ends are pivotally secured to said base at said outer ends.

12. A playset as set forth in claim 11 further including an intermediate toy vehicle receivable in said space and wherein said latch means interact with said intermediate toy vehicle to release said pivoting toy vehicles when said intermediate toy vehicle is impacted.

* * * * *